US007825762B2

(12) United States Patent
Arai

(10) Patent No.: US 7,825,762 B2
(45) Date of Patent: Nov. 2, 2010

(54) TRANSFORMER

(75) Inventor: Nobuaki Arai, Tokorozawa (JP)

(73) Assignee: Tamura Corporation, Tokyo (JP)

( * ) Notice: Subject to any disclaimer, the term of this patent is extended or adjusted under 35 U.S.C. 154(b) by 834 days.

(21) Appl. No.: 10/582,436

(22) PCT Filed: Dec. 10, 2004

(86) PCT No.: PCT/JP2004/018489

§ 371 (c)(1),
(2), (4) Date: Jun. 9, 2006

(87) PCT Pub. No.: WO2005/057595

PCT Pub. Date: Jun. 23, 2005

(65) Prior Publication Data

US 2007/0139149 A1 Jun. 21, 2007

(30) Foreign Application Priority Data

Dec. 10, 2003 (JP) ..... 2003-412512

(51) Int. Cl.
*H01F 27/02* (2006.01)

(52) U.S. Cl. ..... 336/96

(58) Field of Classification Search ..... 336/65, 336/90–96, 200, 232
See application file for complete search history.

(56) References Cited

U.S. PATENT DOCUMENTS 4,112,481 A * 9/1978 Roge et al. ..... 361/736
4,349,801 A * 9/1982 Altmann et al. ..... 336/84 C
5,034,854 A * 7/1991 Matsumura et al. ..... 361/744
5,721,524 A * 2/1998 Delves et al. ..... 336/92
7,498,917 B1 * 3/2009 Yang ..... 336/90

FOREIGN PATENT DOCUMENTS

| | | |
|---|---|---|
| JP | 5-53207 | 7/1993 |
| JP | 5-53234 | 7/1993 |
| JP | 05267082 A * | 10/1993 |
| JP | 6069053 | 3/1994 |
| JP | 6096965 | 4/1994 |
| JP | 6120056 | 4/1994 |
| JP | 6-44117 | 6/1994 |
| JP | 6-244033 | 9/1994 |
| JP | 7-27133 | 5/1995 |
| JP | 10-289828 | 10/1998 |
| JP | 2002033226 | 1/2002 |
| JP | 2002093639 | 3/2002 |
| JP | 2004152981 | 5/2004 |
| JP | 2004253500 | 9/2004 |

* cited by examiner

*Primary Examiner*—Tuyen Nguyen
(74) *Attorney, Agent, or Firm*—Day Pitney LLP

(57) ABSTRACT

A case 12 of a transformer 10 formed in such a manner that a transformer body 13 is accommodated in the case 12 having a rectangular-parallelepiped shape and a resin 14 is filled therein and solidified is configured such that the case 12 has one open face, and side faces 22*a*, 22*b*, 22*c* and 22*d* located at borders of the opening is partially removed, and tape is attached to cover the removed portions 23*a*, 23*b*, 23*c* and 23*d*. With this configuration, since the tape which is sufficiently thinner than the case forms side faces at the removed portions, gap between the transformer body and the case hard to be reduced. Accordingly, the resin is allowed to easily enter therein and air bubbles can be completely removed.

6 Claims, 7 Drawing Sheets

TRANSFORMER

This application is National Stage under 35 U.S.C. §371 of International Application No.: PCT/JP2004/018489, with an International filing date of Dec. 10, 2004. The International Application claims priority of Japanese Application JP2003-412512 with a filing date of Dec. 10, 2003.

TECHNICAL FIELD

The present invention relates to transformers having a structure in which a transformer body is accommodated in a case having a rectangular-parallelepiped shape, the case is filled with resin, and the resin is hardened.

BACKGROUND ART

In conventional small transformers having a high-insulation performance, the coils (windings) of a transformer body is coated with resin (polymer material). Such a transformer has outside dimensions having a certain precision by putting a transformer body in a transfer metal die and applying transfer molding to resin, or by accommodating the transformer body in a case, filling the case with resin in vacuum, and heating the resin to harden it. Transfer metal dies are used for manufacturing transformers that are unlikely to be affected by resin contraction, such as toroidal transformers, while cases are used for manufacturing transformers having a highly-sensitive magnetic material, such as permalloy transformers.

DISCLOSURE OF INVENTION

Problems to be Solved by the Invention

The transformers having a highly-sensitive magnetic material, such as permalloy transformers, described above, are required to have smaller outside dimensions and also to have a higher withstand voltage and a higher insulation performance. When the case size is reduced to make the outside dimensions smaller, gaps between the case and the transformer body become smaller. Therefore, in some cases, it is difficult to pour resin into the case and also for air bubbles to come out of the case. In such a case, since it is difficult to fill the case with the resin, the withstand voltage and insulation performance deteriorate. To solve this problem, the case should have thinner walls to widen the gaps between the case and the transformer body. However, there is a wall-thickness limitation, and the desired smaller case cannot be obtained.

In view of the foregoing various issues, the present invention has been made. An object thereof is to provide a small transformer having a high withstand voltage and a high insulation performance.

Means for Solving the Problems

To achieve the foregoing object, a transformer according to the present invention is a transformer having a structure in which a transformer body is accommodated in a case having a rectangular-parallelepiped shape, the case is filled with resin, and the resin is hardened, characterized in that the case has one open face, side faces located at borders of the opening are partially removed, and tape is attached to cover the removed areas. With this, since the tape, which is sufficiently thinner than the case, serves as side faces at the removed areas of the case, even when the case is made smaller, gaps between the case and the transformer body are not made very small.

Therefore, the resin can be poured into the case easily, and air bubbles can be completely removed.

The removed areas are characterized in that they are located so as to leave edge areas other than the edge areas of the side faces, close to the opening. With this, even when there exist the removed areas, the case can maintain its strength to some extent. In addition, the resin poured is prevented from flowing outside. The removed area is also characterized in that at least one of the side faces is partially removed at the removed area. With this, since a gap having a predetermined width can be obtained at at least one location, the resin can be poured easily into the case, and air bubbles can be completely removed.

The tape is characterized in that the tape is attached by being wound around the side faces. With this, the tape can be easily attached. The resin is characterized in that at least coils and a core constituting the transformer body are coated with the resin. With this, a predetermined withstand voltage and a predetermined insulation performance can be obtained.

The material of the tape can be selected from polyethylene terephthalate tape, polyimide tape, aramid tape, and epoxy-impregnated polyester tape.

To achieve the foregoing object, the present invention provides, in another aspect, a transformer having a structure in which a transformer body is accommodated in a case, the case is filled with resin, and the resin is hardened. The case has a bottom face, and protrusions formed upright from the bottom face at four corners of the bottom face. Further, tape is attached to the case so as to cover the protrusions from the outside of the case, and the tape serves as side faces of the case. With such a structure, since the tape, which is sufficiently thinner than the case, serves as side faces of the case, even when the case is made smaller, gaps between the case and the transformer body are not made very small. Therefore, the resin can be poured into the case easily, and air bubbles can be completely removed.

In another aspect, the present invention provides a transformer manufacturing method including the steps of making a case having a rectangular-parallelepiped shape, structured such that one face is opened and side faces located at borders of the opening are partially removed; winding tape around the case at the side faces so as to cover the removed areas at the side faces of the case; and filling the case with resin. In a transformer manufactured by this manufacturing method, since the tape, which is sufficiently thinner than the case, serves as side faces at the removed areas of the case, even when the case is made smaller, gaps between the case and the transformer body are not made very small. Therefore, the resin can be poured into the case easily, and air bubbles can be completely removed.

In another aspect, the present invention provides a transformer that includes a case having a rectangular-parallelepiped shape, structured such that one face is opened and side faces located at borders of the opening are partially removed; and a transformer body accommodated in the case. The transformer is manufactured such that tape is wound around the case at the side faces so as to cover the removed areas at the side faces of the case, then, the case is filled with resin, and the tape is removed from the case. With such a structure, since the tape, which is sufficiently thinner than the case, serves as side faces at the removed areas of the case, even when the case is made smaller, gaps between the case and the transformer body are not made very small. Therefore, the resin can be poured into the case easily, and air bubbles can be completely removed.

In another aspect, the present invention provides a transformer manufacturing method including the steps of making a case having a rectangular-parallelepiped shape, structured such that one face is opened and side faces located at borders of the opening are partially removed; winding tape around the case at the side faces so as to cover the removed areas at the side faces of the case; filling the case with resin; hardening the resin; and removing the tape from the case. In a transformer manufactured by this manufacturing method, since the tape, which is sufficiently thinner than the case, serves as side faces at the removed areas of the case, even when the case is made smaller, gaps between the case and the transformer body are not made very small. Therefore, the resin can be poured into the case easily, and air bubbles can be completely removed.

DESCRIPTION OF REFERENCE NUMERALS

1: Manufacturing jig
2: First jig
3: Second jig
10: Transformer
11: Tape
12: Case
13: Transformer body
14: Resin
21: Opening
22*a*, 22*b*, 22*c*, 22*d*: Side faces
23*a*, 23*b*, 23*c*, 23*d*: Removed areas 24*aa*, 24*ab*, 24*ba*, 24*bb*, 24*ca*, 24*cb*, 24*da*, 24*db*, 24*ac*, 24*bc*, 24*cc*, 24*dc*: edge areas

Best Mode For Carrying Out The Invention

Figure 1:
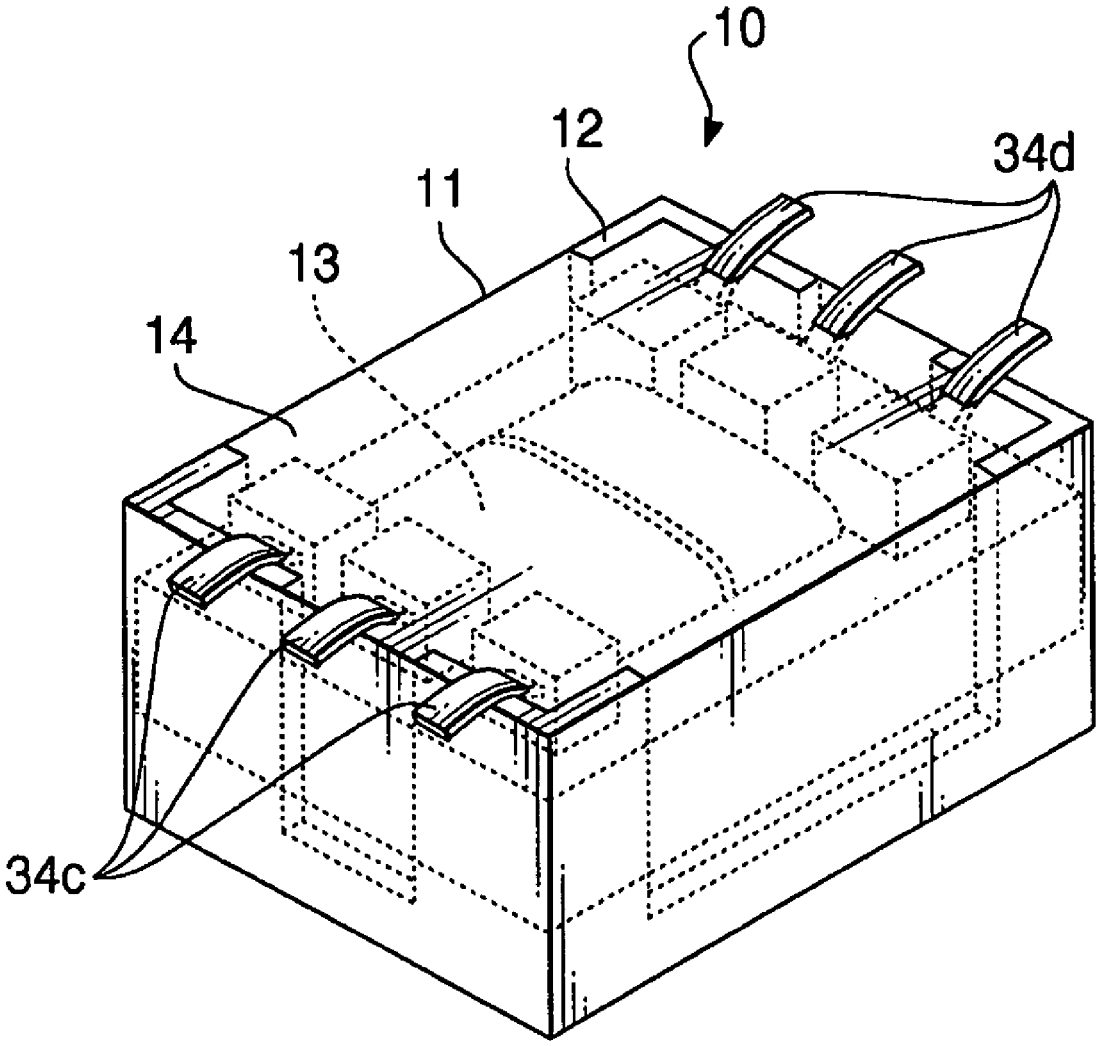
FIG. 1 is a perspective view of a transformer according to an embodiment of the present invention.

FIG. 1 is a perspective view of a transformer according to an embodiment of the present invention. This transformer 10 has a structure in which tape 11 is wound around a hollow case 12 having a rectangular-parallelepiped shape, at side faces shown in the figure, a transformer body 13 is accommodated in the case 12, the case 12 is filled with resin 14, and the resin 14 is hardened. The transformer 10 is used for sound signals, and has a high withstand voltage and a high insulation performance although it has a small size. The transformer 10 is formed such that terminals 34*c* and 34*d* of the transformer body 13 protrude from edges on an upper face shown in the figure of the case 12. The transformer 10 is placed on a printed wiring board such that the upper face faces the printed wiring board, and is mounted by connecting the terminals 34*c* and 34*d* to terminals formed on the printed wiring board, with solder or other means.

Figure 2:
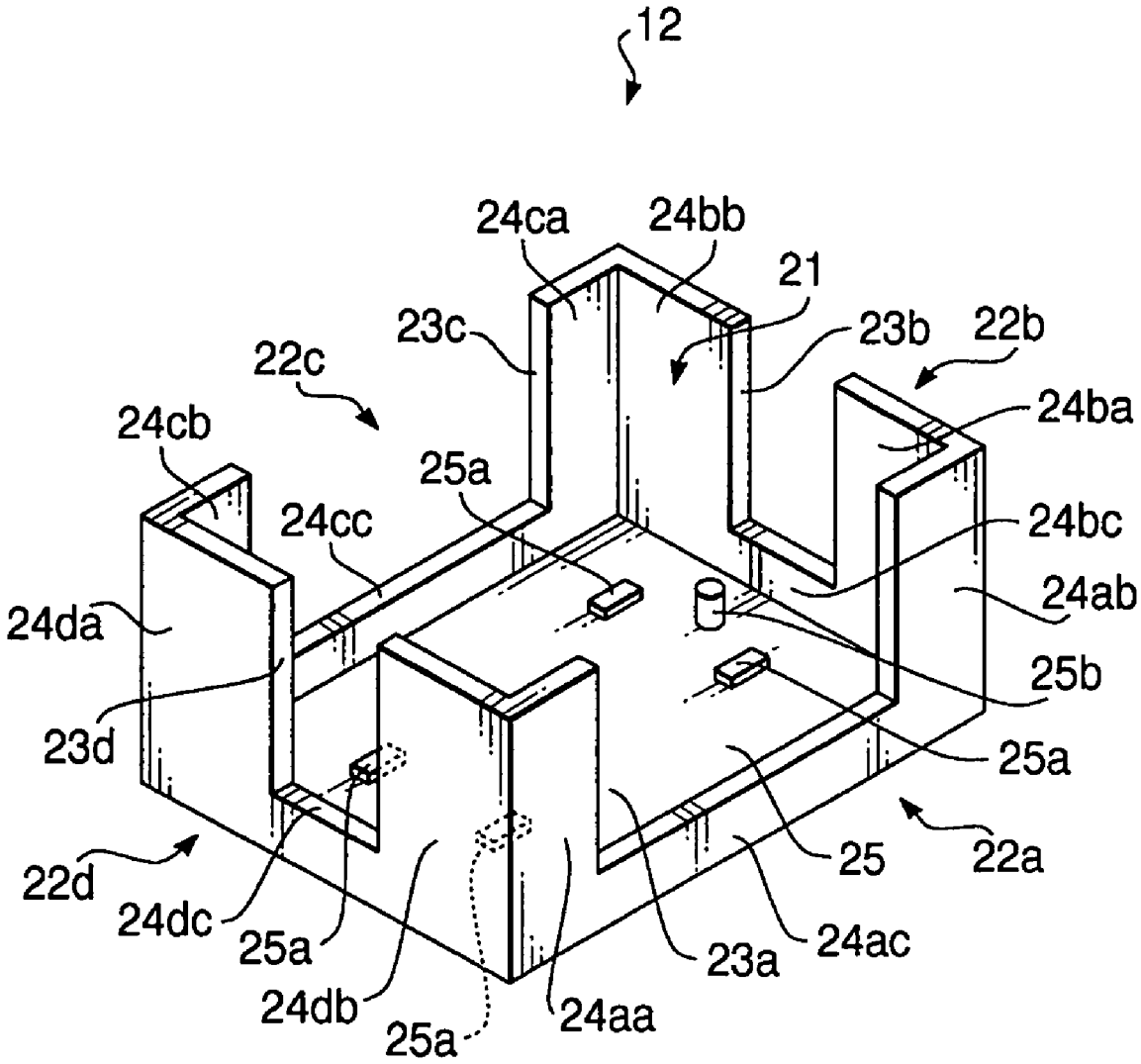
FIG. 2 is a perspective view of an example of a case shown in FIG. 1.

FIG. 2 is a perspective view of an example of the case 12. The case 12 does not have a wall at the upper face shown in the figure. From this opening 21, the transformer body 13 is inserted and placed on a bottom face shown in the figure. In addition, in the case 12, four side faces 22*a*, 22*b*, 22*c*, and 22*d* positioned at the borders of the opening 21 are partially removed. The removed areas 23*a*, 23*b*, 23*c*, and 23*d* have rectangular shapes so as to leave edge areas other than the edge areas at the opening 21 side, of the side faces 22*a*, 22*b*, 22*c*, and 22*d*, namely, edge areas 24*aa*, 24*ab*, 24*ba*, 24*bb*, 24*ca*, 24*cb*, 24*da*, and 24*db* of the side faces 22*a*, 22*b*, 22*c*, and 22*d* and edge areas 24*ac*, 24*bc*, 24*cc*, and 24*dc* close to the bottom face 25.

Further, in the case 12, four bumps 25*a* and one protruding portion 25*b* used for positioning the transformer body 13 are formed at the bottom face 25. The four bumps 25*a* are formed close to the four corners of the bottom face 25 to support the transformer body 13 to be accommodated. The protruding portion 25*b* is formed between a pair of bumps 25*a* close to the side face 22*b* so as to interfere with a protruding portion 33*aa* (see FIG. 4) formed on a flange 33 when the transformer body 13 is accommodated with a wrong orientation.

With the case 12 having the above-described structure, when the tape 11 is attached so as to cover the removed areas 23*a*, 23*b*, 23*c*, and 23*d*, the tape 11, which is sufficiently thinner (for example, having a thickness of about 0.025 mm to 0.050 mm) than the case 12 (for example, having a thickness of about 0.2 mm), serves as side faces at the removed areas 23*a*, 23*b*, 23*c*, and 23*d* of the case 12. Therefore, even when the case 12 is reduced in size, gaps between the case 12 and the transformer body 13 are not made very small. The resin 14 can be poured into the case 12 through the gaps easily, and air bubbles can be completely removed through the gaps. Especially, the resin 14 is poured into the case 12 through the removed areas 23*a* and 23*c*, which are located at the longer sides, and air is discharged from the case 12 through the removed areas 23*b* and 23*d*, which are located at the shorter sides, as the resin 14 is poured. Therefore, the transformer 10 can be made to have a small size and a high withstand voltage and a high insulation performance. The removed areas 23*a* and 23*c*, which are located at the longer sides, should be formed, but the removed areas 23*b* and 23*d*, which are located at the shorter sides, may be not formed.

Since the removed areas 23*a*, 23*b*, 23*c*, and 23*d* are located at all of the four side faces 22*a*, 22*b*, 22*c*, and 22*d* of the case 12, winding the tape 11 around the case 12 on the side faces 22*a*, 22*b*, 22*c*, and 22*d* covers all the removed areas 23*a*, 23*b*, 23*c*, and 23*d*, increasing the efficiency of attaching the tape 11. The material of the tape 11 needs to tolerate the resin 14 at its hardening temperate for its hardening period (for example, at 100° C. to 110° C. for one hour) and to tolerate soldering at its temperature for its period (for example, at 230° C. to 250° C. for one hour). As the material, polyester, polypropylene, or others are used. When the name of the manufacturing company, the manufacturing number, and other items of the transformer 10 are printed on a surface of the tape 11 in advance, for example, since it is not necessary to print those items on the transformer 10 after it has been manufactured, the printing process can be omitted. More specifically, the material of the tape 11 is polyethylene terephthalate tape, polyimide tape, aramid tape, epoxy-impregnated polyester tape, or others.

The case 12 is formed so as to leave the edge areas 24*aa*, 24*ab*, 24*ba*, 24*bb*, 24*ca*, 24*cb*, 24*da*, and 24*db* of the side faces 22*a*, 22*b*, 22*c*, and 22*d* and the edge areas 24*ac*, 24*bc*, 24*cc*, and 24*dc* close to the bottom face 25. Therefore, the case 12 has a reinforcement function for preventing the case 12 from bending when it is handled or when the resin 14 is poured into, and a barrier function for preventing the resin 14 from leaking from the bottom face 25.

Figure 3:
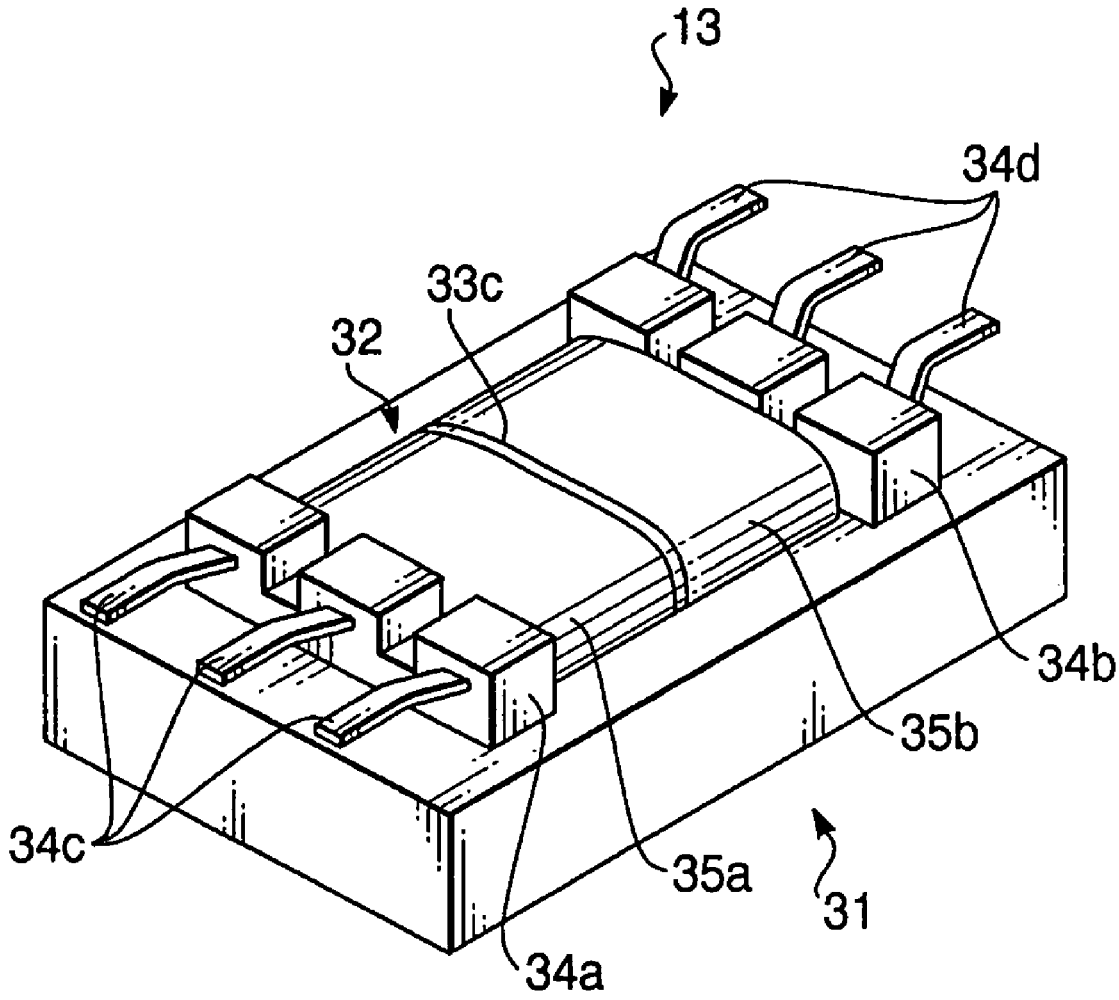
FIG. 3 is a perspective view of an example of a transformer body shown in FIG. 1.
Figure 4:
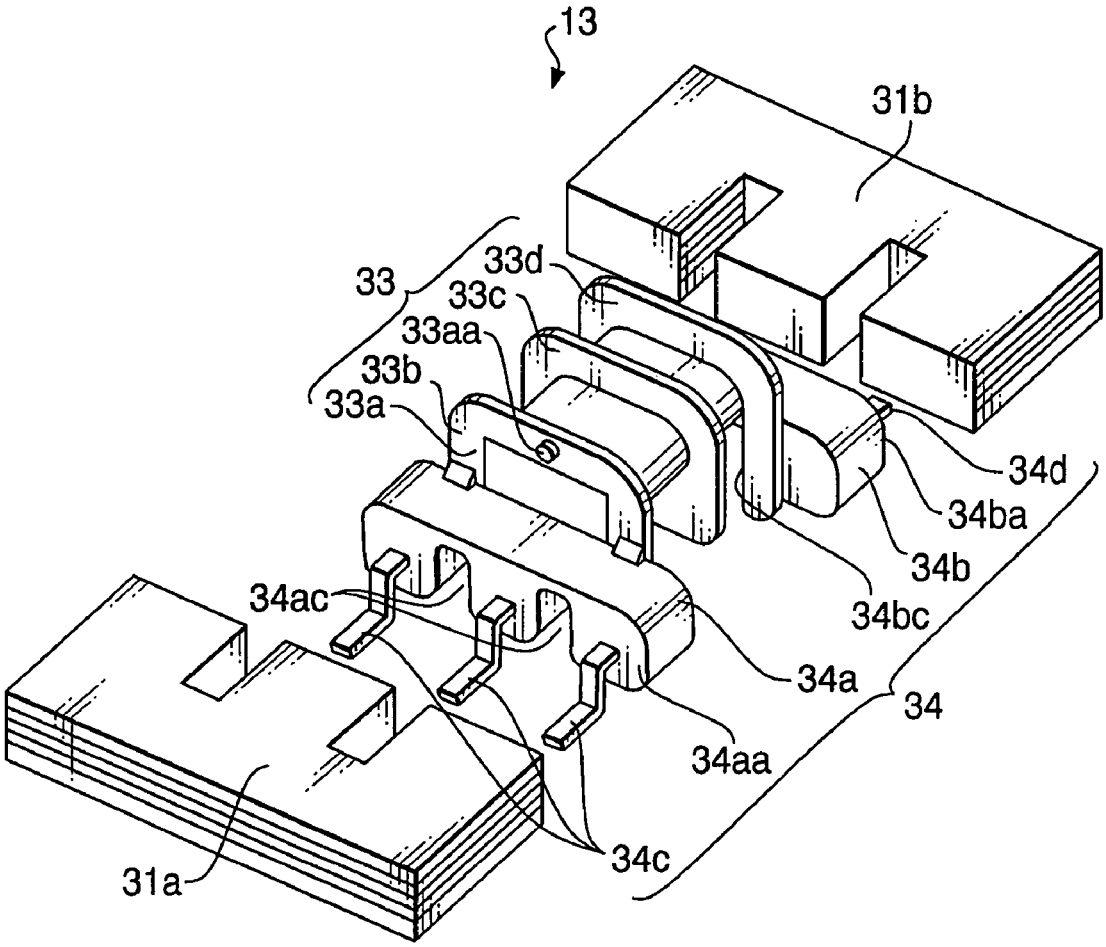
FIG. 4 is an exploded perspective view of FIG. 3.

FIG. 3 is a perspective view of an example of the transformer body 13, and FIG. 4 is an exploded perspective view thereof. This transformer body 13 is formed of a core section 31 and a bobbin section 32. The core section 31 has, for example, a pair of so-called E-type cores 31*a* and 31*b* where permalloy plates are laminated. The bobbin section 32 has a winding drum section 33 and a terminal section 34. The winding drum section 33 includes a hollow, cylindrical winding drum component 33*a* and flanges 33*b*, 33*c*, and 33*d* provided at both ends and a center of the winding drum component 33*a*.

For example, a primary coil 35*a* is wound around the winding drum component 33*a* between the flanges 33*b* and 33*c*, and a secondary coil 35*b* is wound around the winding drum component 33*a* between the flanges 33*c* and 33*d*. The flanges 33*b*, 33*c*, and 33*d* are each provided with a hollow part connected to the hollow part of the winding drum component 33*a*. The E-type core 31*a*, one of the pair of E-type cores, is inserted into the hollow part of the winding drum component 33*a* through the hollow part of the flange 33*b*, and the E-type core 31*b*, the other of the pair of E-type cores, is inserted into the hollow part of the winding drum component 33*a* through the hollow part of the flange 33*d*.

The terminal section 34 has two bodies 34*a* and 34*b*, and three terminals 34*c* and three terminals 34*d* extended from the bodies 34*a* and 34*b*, respectively. The bodies 34*a* and 34*b* are made from an insulating material in a rectangular-parallelepiped shape. The bodies 34*a* and 34*b* are provided, at side faces 34*aa* and 34*ba*, with lead grooves 34*ac* and 34*bc* for drawing leads of the primary coil 35*a* and the secondary coil 35*b* wound around the winding drum component 33*a*, respectively.

The terminals 34*c* and 34*d* are made from a metal material in an almost Z-letter shape. The terminals 34*c* and 34*d* are integrated with the bodies 34*a* and 34*b* such that the terminals 34*c* and 34*d*, three each, protrude from the side faces 34*aa* and 34*ba* of the bodies 34*a* and 34*b*, respectively. End portions close to the side faces 34*aa* and 34*ba* of the bodies 34*a* and 34*b*, of the terminals 34*c* and 34*d* serve as binding portions where the leads of the primary coil 35*a* and the secondary coil 35*b* are bound, and tip portions of the terminals 34*c* and 34*d*, far from the side faces 34*aa* and 34*ba* of the bodies 34*a* and 34*b*, serve as mounting portions to be mounted on a printed wiring board.

Figure 5:
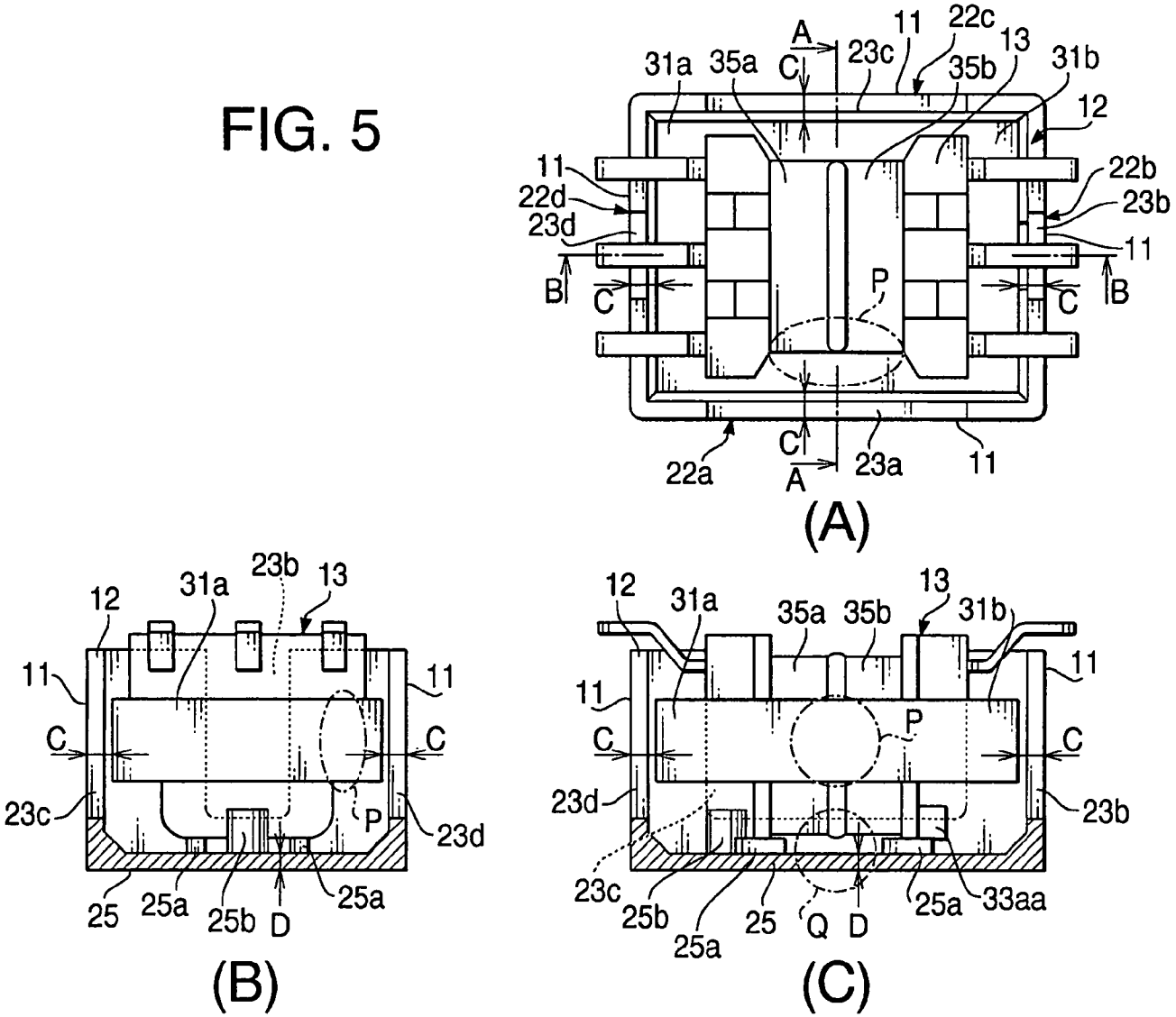
FIG. 5(A) is a plan of the transformer in a state where the case is not filled with resin shown in FIG. 1.
FIG. 5(B) is a cross-sectional view taken along line A-A.
FIG. 5(C) is a cross-sectional view taken along line B-B.

FIG. 5(A), FIG. 5(B), and FIG. 5(C) are respectively a plan, a cross-sectional view taken along line A-A, and a cross-sectional view taken along line B-B of the case 12 in a state obtained before the case 12 is filled with the resin 14. As the resin 14, thermosetting resin, epoxy resin, urethane rein, or others are used. Since the resin 14 is relatively viscous, it is difficult to pour the resin 14 through a narrow gap. Because gaps C between the tape 11 and the transformer body 13 are larger due to the removed areas 23*a*, 23*b*, 23*c*, and 23*d* located at the side faces 22*a*, 22*b*, 22*c*, and 22*d* of the case 12 than those obtained when the case 12 is used without any removed areas, the case 12 can be filled entirely to the inside corners with the resin 14. Especially, laminated portions of the E-type cores 31*a* and 31*b*, where dielectric breakdown is likely to occur and which are indicated by P in the figure, can be covered with the resin 14. Therefore, the insulation performance is improved.

Since a gap D between the bottom face 25 and the transformer body 13 is relatively broad due to the bumps 25*a* formed on the bottom face 25 of the case 12, it is possible to fill the case 12 entirely to the inside corners with the resin 14. Especially, a gap between the primary coil 35*a* and the secondary coil 35*b*, where dielectric breakdown is likely to occur and which is indicated by Q in the figure, can be covered with the resin 14. Therefore, the insulation performance is improved. Even when the resin 14 has been hardened, it is likely to be scratched because its hardness is relatively low. Since the side faces 22*a*, 22*b*, 22*c*, and 22*d* of the case 12, especially, the removed areas 23*a*, 23*b*, 23*c*, and 23*d*, are covered by the tape 11, the resin 14 is protected.

Figure 6:
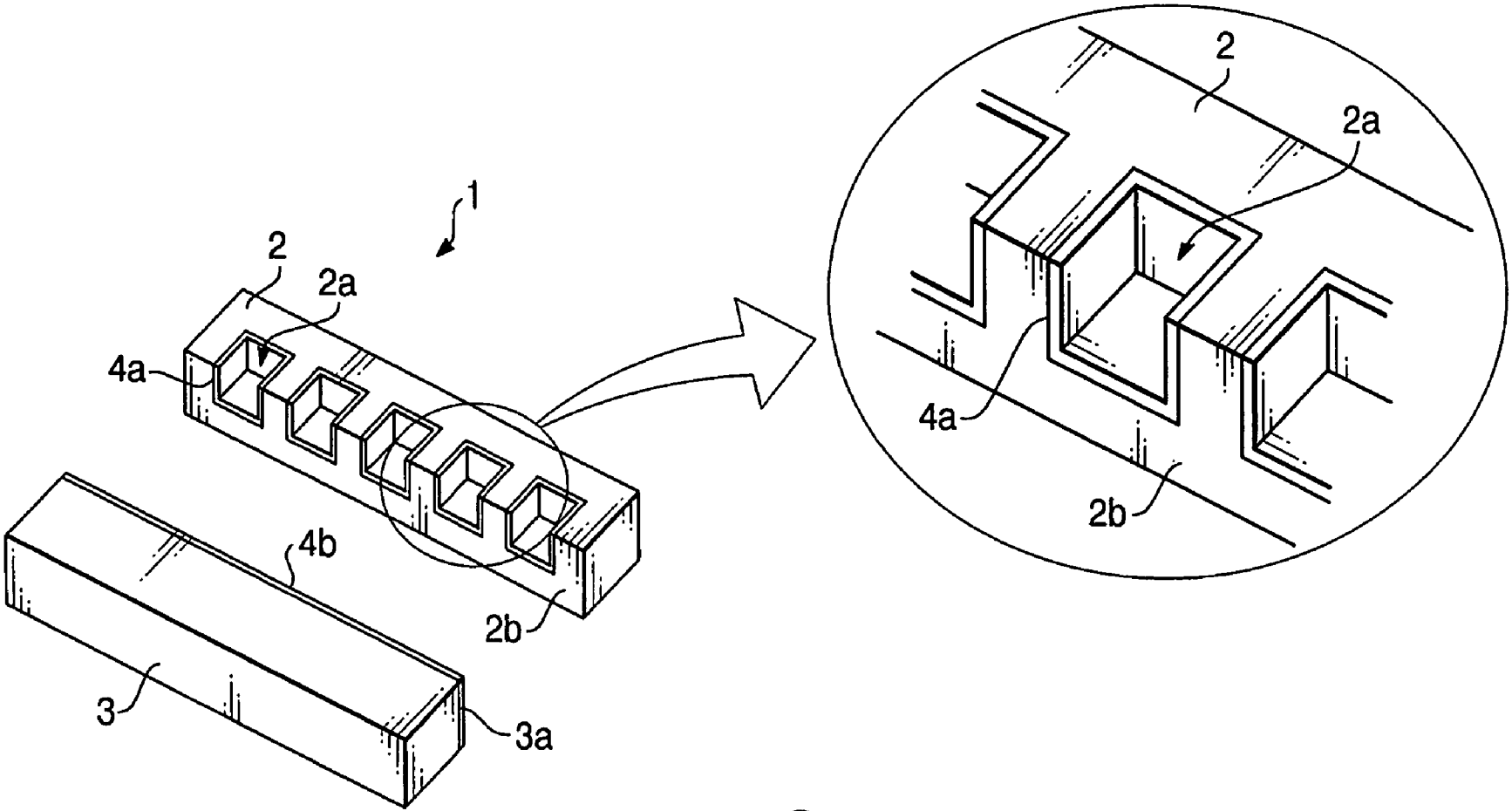
FIG. 6 is a perspective view of an example manufacturing jig used for the transformer shown in FIG. 1.

FIG. 6 is a perspective view of an example manufacturing jig for the transformer 10. This manufacturing jig 1 is formed of a first jig 2 and a second jig 3. The first jig 2 is made, for example, from aluminum or other materials in a rectangular-parallelepiped shape. The first jig 2 is provided with a predetermined number (five in this example) of cavities 2*a* in each of which the case 12 around which the tape 11 is wound can be placed, side by side with two faces perpendicular to each other being opened. The cavities 2*a* are coated, for example, with silicone rubber 4*a* at their inside faces so as to easily take off the cases 12, around which the tape 11 is wound. The second jig 3 is made, for example, from aluminum or other materials in a rectangular-parallelepiped shape. The second jig 3 is formed so as to be able to block one opening face of each of the cavities 2*a* when in contact with a face 2*b* where the cavities 2*a* are formed in the first jig 2. A face 3*a* to be in contact with the face 2*b* where the cavities 2*a* are formed in the first jig 2 is coated, for example, with silicone rubber 4*b* so as to easily take off the cases 12, around which the tape 11 is wound.

Figure 7:
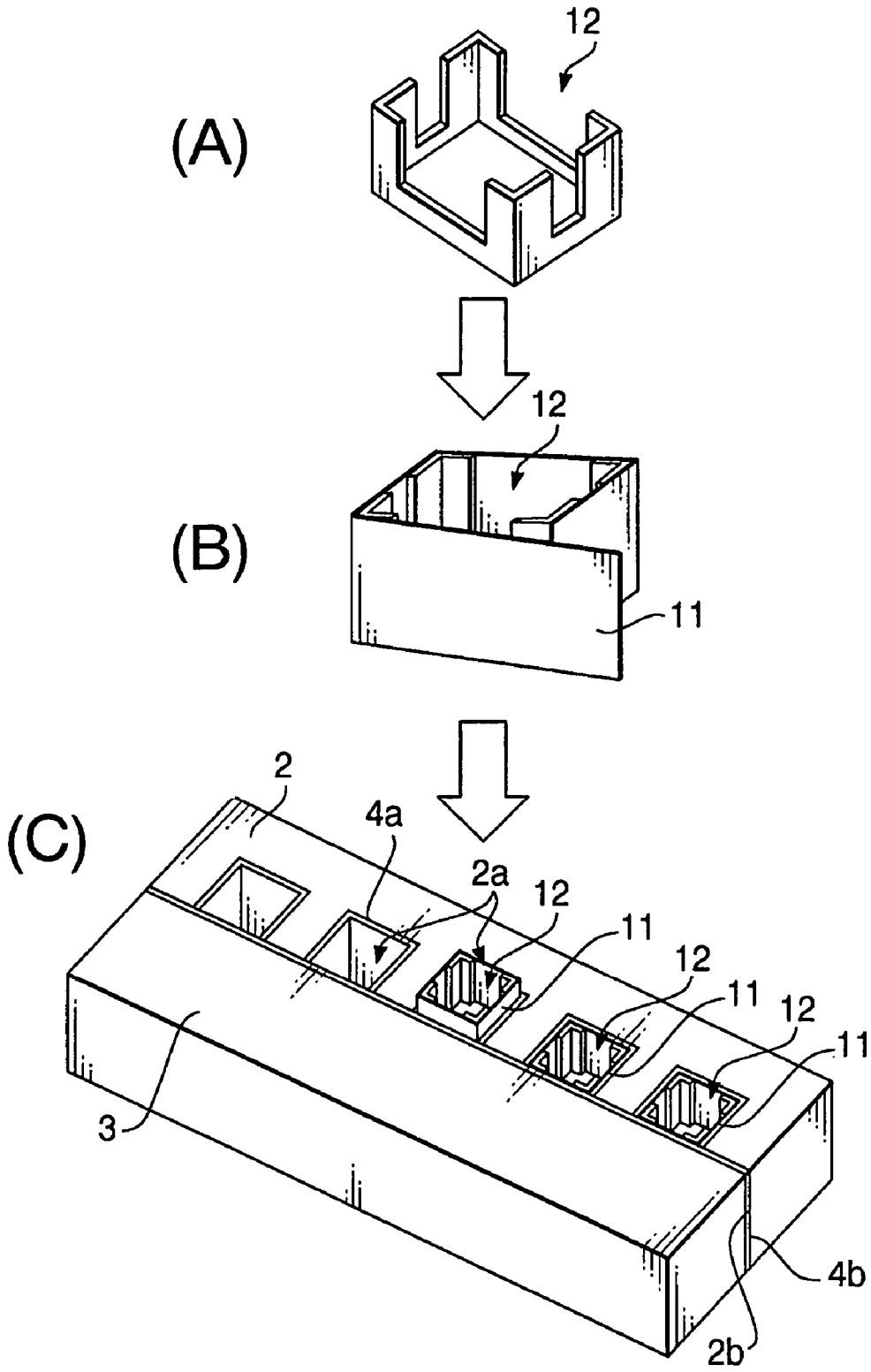
FIG. 7(A) to FIG. 7(C) show a transformer manufacturing process where the manufacturing jig shown in FIG. 6 is used.

FIG. 7 is a view showing a part of a manufacturing process of the transformer 10, where the manufacturing jig 1 is used. First, each case 12 is made by injection molding or other methods (FIG. 7(*a*)), and the tape 11 is wound around the case 12 at its sides (FIG. 7(*b*)). Then, the face 2*b* where the cavities 2*a* are formed in the first jig 2 is made in advance in contact with the surface of the silicone rubber 4*b* in the second jig 3, and the case 12 around which the tape 11 has been wound is inserted into each cavity 2*a* (FIG. 7(*c*)). Next, a transformer body 13 already assembled is placed in the case 12, and the case 12 is filled with the resin 14 in vacuum. The entire manufacturing jig I is heated and hardened at a predetermined temperature for a predetermined period of time, the first jig 2 and the second jig 3 are separated, and each completed transformer 10 is taken out from the cavity 2*a*, finishing one cycle.

The above-described embodiment is just one embodiment of the present invention. The scope of the present invention is not limited to that of the above-described embodiment, and the present invention can be applied to other various embodiments in the scope described in claims. For example, in the above-described embodiment, all of the four side faces 22*a* , 22*b*, 22*c*, and 22*d* of the case 12 are partially removed at the removed areas 23*a*, 23*b*, 23*c*, and 23*d*. The same advantages are obtained when at least one of the four faces is partially removed. In that case, the tape 11 needs to be attached so as to cover the removed area. In the above-described embodiment, the removed areas 23*a*, 23*be*, 23*c*, and 23*d* has rectangular shapes. The corners thereof may be chamfered or rounded to increase strength.

In the above-embodiment, the removed areas 23*a*,23*b*,23*c*, and 23*d* are made so as to leave the edge areas 24*aa*, 24*ab*, 24*ba*, 24*bb*, 24*ca*, 24*cb*, 24*da*, and 24*db* of the side faces 22*a*, 22*b*, 22*c*, and 22*d*, that is, to have L-shaped cross-sectional portions. The corners of the cross sections may be chamfered or rounded to increase strength. In addition, instead of the edge areas 24*aa*, 24*ab*, 24*ba*, 24*bb*, 24*ca*, 24*cb*, 24*da*, and 24*db*, pins having a cylindrical shape, a triangular-prism shape, or others may be set up at the four corners of the bottom face 25.

The transformer 10 is usually used with the tape 11 being wound around. The transformer 10 may be used with the tape being removed from the case 12. Even in such a case, since the case 12 is filled entirely to the inside corners with the resin 14, the advantages provided by the transformer 10 is maintained. This type of transformer is made by removing the tape 11 from the case 12 at the last step of the manufacturing process of the transformer 10, described by referring to FIG. 7(*a*) to FIG. 7(*c*), that is, when the transformer 10 has been taken out from the manufacturing jig 1 after the resin 14 was hardened.

As described above, according to the present invention, since the tape, sufficiently thinner than the case, serves as side faces at the removed areas of the case, even if the case is made smaller, gaps between the case and the transformer body are not made very small. Therefore, resin can be poured into the case through the gaps easily, and air bubbles can be completely removed from the case. The transformer has a small size and a high withstand voltage and a high insulation performance.

INDUSTRIAL APPLICABILITY

The present invention can also be applied to circuit components having accommodation cases, other than transformers, such as consumer electric produces including television sets and washing machines, and high-voltage generators and booster circuits used for automobiles and others.

The invention claimed is:

1. A transformer having a structure in which a transformer body, including coils, terminals, and a core, is accommodated in a case having a rectangular-parallelepiped shape, the case is filled with resin, and the resin is hardened, characterized in that the case has one open face through which said terminals extend when said transformer is assembled, side faces located at borders of the open face, each having areas, extending to said open face, which are partially removed, and tape is attached around an outside of said case to cover the removed areas;

wherein a resin fellable volume of said transformer, around said transformer body and within said case, is increased when assembled.

2. The transformer according to claim 1, characterized in that the removed areas are located so as to leave edge areas other than the edge areas of the side faces, close to the opening.

3. The transformer according to claim 1, characterized in that at least one of the side faces is partially removed at the removed area.

4. The transformer according to claim 1, characterized in that the tape is attached by being wound around the side faces.

5. The transformer according to claim 1, characterized in that at least the coils and the core constituting the transformer body are coated with the resin.

6. The transformer according to claim 1, characterized in that the material of the tape is selected from polyethylene terephthalate tape, polyimide tape, aramid tape, and epoxy-impregnated polyester tape.

* * * * *